US005579923A

United States Patent [19]

Hemmerlein

[11] Patent Number: 5,579,923

[45] Date of Patent: Dec. 3, 1996

[54] FIREARM SAFETY AND SECURITY DEVICE FOR PREVENTING THE THEFT AND FIRING OF A WEAPON

[76] Inventor: Herbert W. Hemmerlein, P.O. Box 29, Newburgh, Ind. 47629-029

[21] Appl. No.: 161,404

[22] Filed: Dec. 6, 1993

[51] Int. Cl.[6] ..... A47F 7/00

[52] U.S. Cl. ..... 211/4; 211/64; 248/552; 42/70.11

[58] Field of Search ..... 211/64, 4; 248/552; 42/70.11

[56] References Cited

U.S. PATENT DOCUMENTS

| | | | |
|---|---|---|---|
| 3,468,427 | 9/1969 | Leslie | 211/64 |
| 4,050,662 | 9/1977 | Pickering | 211/64 X |
| 4,198,026 | 4/1980 | Capolupo | 211/64 X |
| 4,624,372 | 11/1986 | Brolin | 211/64 X |
| 4,936,038 | 6/1990 | Johnson et al. | 211/64 X |
| 5,188,328 | 2/1993 | Thompson | 211/64 X |
| 5,271,174 | 12/1993 | Bentley | 42/70.11 |

*Primary Examiner*—Robert W. Gibson, Jr.
*Attorney, Agent, or Firm*—Woodard, Emhardt, Naughton Moriarty & McNett

[57] ABSTRACT

A firearm safety and security device for preventing the theft and discharge of a weapon. One form of the firearm security device includes a rod extending down the bore of the firearm barrel and into an empty shell chamber. An upstanding post extends outward from a base plate and is located between the trigger guard and the trigger. A lock is positionable through the post passing through the trigger guard and secures the firearm to the base plate. An anchor plate is utilized to sandwich the base plate and the hold down plate on either side of a shelf. Further, the firearm security device prevents removal of the firearm from the home or business.

19 Claims, 2 Drawing Sheets

FIREARM SAFETY AND SECURITY DEVICE FOR PREVENTING THE THEFT AND FIRING OF A WEAPON

BACKGROUND OF THE INVENTION

The present invention relates generally to the design and construction of a firearm safety and security system. More particularly, the present invention secures the firearm to a solid shelf or countertop while a safety rod is receivable within the barrel of the firearm to prevent the weapon from being cocked or fired.

A concern of many firearm owners is that children may gain unauthorized access to these weapons with the consequence of someone being injured or killed. Another common concern of many firearm owners is that the firearms may be stolen from their home or place of business. Further, many people in todays society rely upon the ownership of firearms to provide personal protection, and therefore place their respective weapons in a place for fast and easy access.

Balancing the competing policies for firearm security with the need for ready availability of the weapon as a crime deterrent make a firearm security system almost a necessity. The prior firearm security devices have not fulfilled the many parameters necessary for a universal firearm security system. One common class of firearm security device includes locks that fit over the trigger guard of the firearm, or cables that are coupled with the barrel and firing mechanism of the firearm to prevent accidental discharge. Generally, these prior art devices have not eliminated tampering by unauthorized parties and are readily removeable by an unauthorized person with rather unsophisticated tools, such as a drill.

Even with the variety of earlier designs for securing a firearm there remains a need for an improved firearm security system. The present invention verifies this need in a novel and obvious way.

SUMMARY OF THE INVENTION

A firearm security device, comprising: a base plate; a first upstanding post attached to the base plate; a member connected to the first upstanding post, the member receivable within the barrel of the firearms; a second upstanding post attached to the base plate, the second post positioned so as to be receivable through the trigger guard of the firearm and locking means connectable with the second upstanding post for preventing the removal of the firearm from the second post.

One object to one form of the present invention is to provide an improved firearm security apparatus.

Related object and advantages of the present invention will be apparent from the following description.

DESCRIPTION OF THE PREFERRED EMBODIMENT

Figure 1:
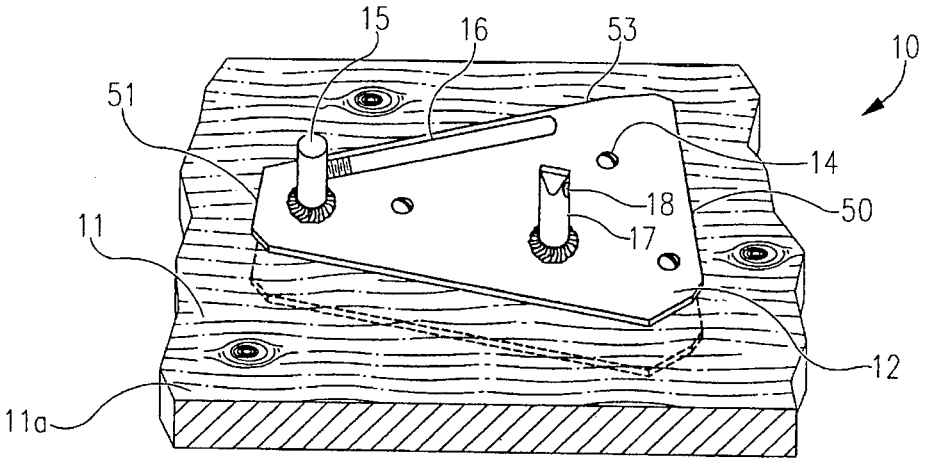
FIG. 1 is a perspective view of one embodiment of the firearm security system invention connected to a piece of shelving or countertop.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
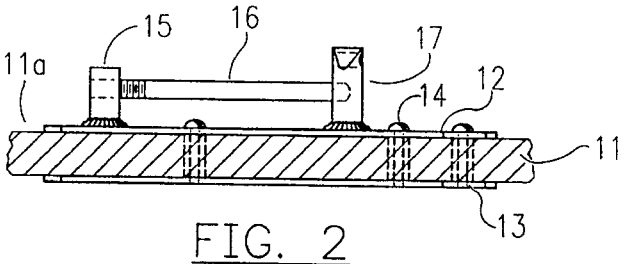
FIG. 2 is a side elevational view of the firearm security system of FIG. 1 connected to a piece of shelving.
Figure 3:
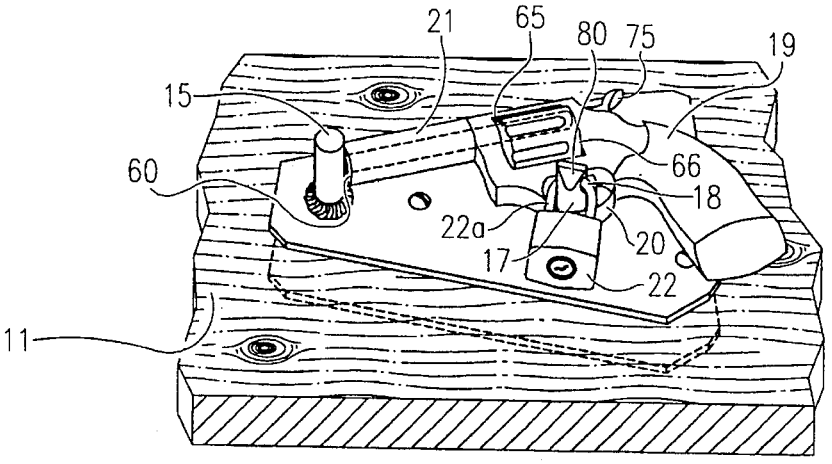
FIG. 3 is a perspective view of the FIG. 1 firearm security system having a firearm mounted thereon.
Figure 4:
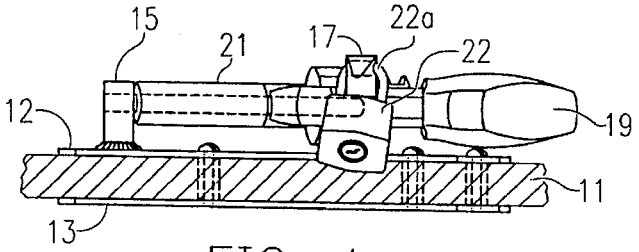
FIG. 4 is a side elevational view of the FIG. 3 firearm security device with a firearm mounted thereon.

With reference to FIG. 1 and 2 there is illustrated one embodiment of a firearm security device 10. Firearm security device 10 is designed to be securely fastened to the underside of a shelf and/or counter 11. A typical application of the firearm security device 10 would be to mount the firearm security device 10 beneath a cash register such as in a place of business. The firearm security device 10 will secure the firearm while placing it in a readily accessible location for the store attendant. In an alternate form of the present invention multiple firearms are secured to the firearm security device.

The firearm security device 10 includes a base plate 12 which is securely mounted on a first surface 11*a* of the shelf or counter 11 by a plurality of fasteners 14. In the preferred embodiment the base plate 12 is formed of an about eighty gage or 3/16 inch steel plate. In one form of the present invention the base plate has been sized to be about 9½ inches long and about 5.25 inches at a first end 50 and about 2 inches at a second end 51. It is understood by one skilled in the art that other geometric sizes and shapes are contemplated by the present invention.

Figure 5:
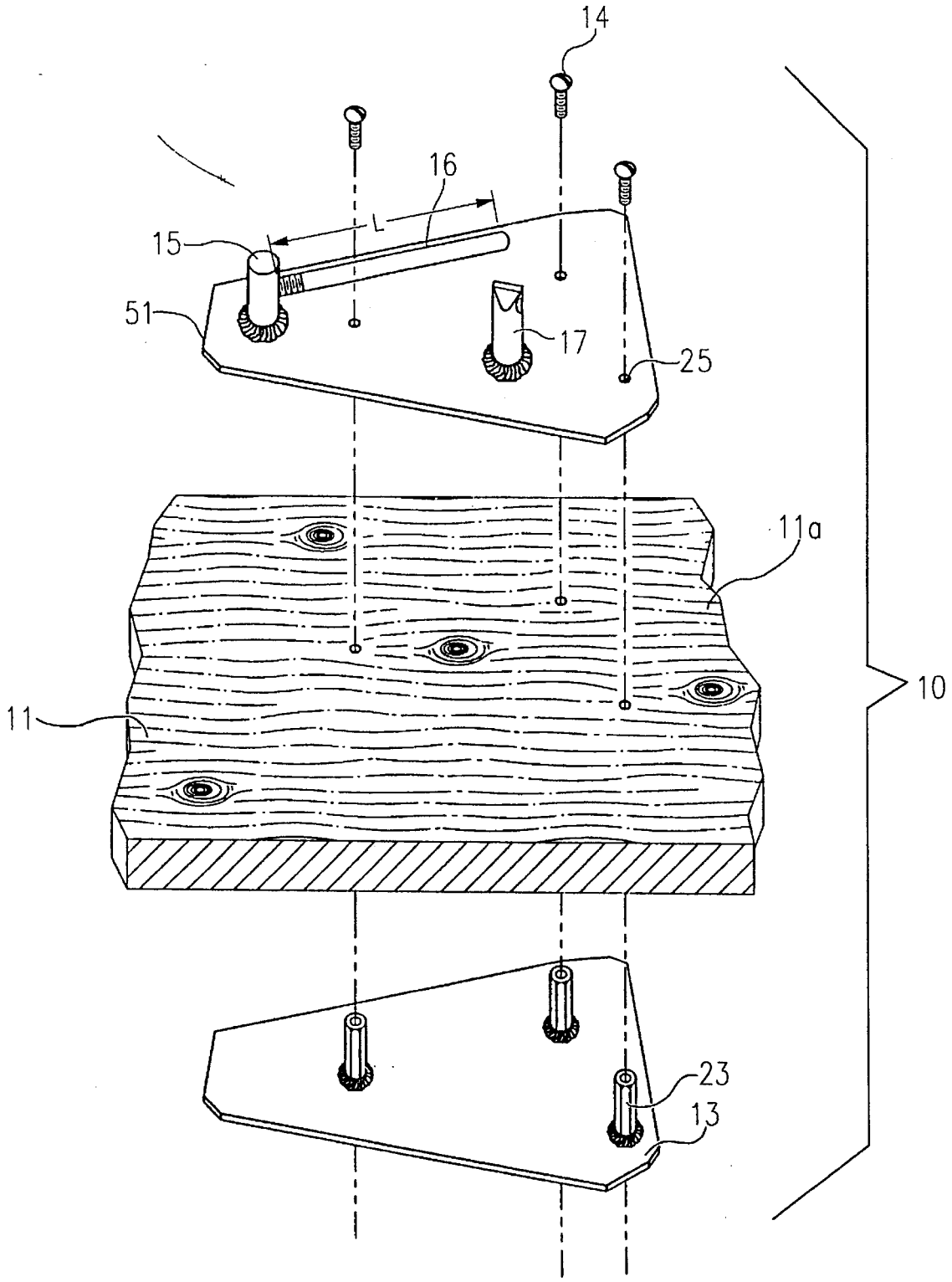
FIG. 5 is an exploded view of the firearm security device of FIG. 1.

An anchor or hold down plate 13 is located adjacent a second surface 11*b* of the shelf or counter 11. In the preferred embodiment the base plate 12 and hold down plate 13 sandwich the shelf and/or counter 11. The plurality of fasteners 14 pass through apertures 25 formed in the base plate 12 and are received into the hold down plate 13. In the preferred embodiment the hold down plate 13 includes a plurality of upstanding extension nuts 23 (FIG. 5). The upstanding extension nuts 23 pass through a plurality of apertures 55 formed within the shelf and/or counter 11. The fasteners 14 pass through the base plate 12 and engage the extension nuts 23 of the hold down plate 12, thereby locking the firearm security device 10 securely in place on the shelf 11. In the preferred embodiment the fasteners 14 are stainless steel bolts.

The firearm security device 10 includes a pair of upstanding posts 15 and 17 that are utilized to lock a firearm 19 securely to base plate 12. In the preferred embodiment barrel post 15 is permanently affixed to the second end 51 of base plate 12. In the preferred embodiment the barrel post has an outside diameter of about ¾ inches and is located about one and one half inches from second end 51 of base plate 12. Conventional manufacturing techniques utilized to attach the barrel post 15 to base plate 12 include welding and/or a threaded connection. Other fastening techniques delivering a similar attachment of the post 15 to plate 12 are contemplated herein.

A member is securely connected to the barrel post 15, and in the preferred embodiment a barrel safety rod 16 is securely connected to the barrel post 15. The barrel safety rod 16 extends parallel to edge 53 and base plate 12. Barrel safety rod 16 has an outside diameter sized to be received within a bore 60 of a barrel 21 of firearm 19. In the preferred embodiment barrel safety rod 16 is formed of brass. For illustrative purposes, and without limitation, the barrel safety rod 16 is shown for a thirty-eight caliber revolver having a four inch barrel. The barrel safety rod 16 has an outside diameter of about 5/16 of an inch and a length "L" of about 5.25 inches. The barrel safety rod 16 is sized to freely slide into the bore 60 of barrel 16 and continue into an empty chamber 65 of the firearm 19. The passage of the barrel safety rod 16 through bore 60 of the firearm barrel 21 allows the weapon to rotate or freely swivel thereon. The barrel safety rod 16 goes all the way down the barrel and into the empty chamber. In the preferred embodiment the barrel rod 16 passes about one and one quarter inches into the chamber. The deployment of the barrel safety rod 16 into the empty chamber 65 makes it impossible to cock or rotate cylinder 66, or pull the trigger to discharge the firearm 19. It is understood by those skilled in the art that other rod diameters and rod lengths are within the contemplation of the present invention. The selection of the appropriate barrel safety rods outside diameter and length to match the firearm and within the general knowledge of someone skilled in the art.

Trigger post 17 is permanently affixed to base plate 12 and is positioned such that when the firearm 19 is mounted on base plate 12 the trigger post 17 extends through the trigger guard 20. In the preferred embodiment the trigger post 17 is mounted in an upstanding relationship with respect to the base plate 12. In one form of the present invention the trigger post 17 has an outside diameter of about 5/8 of an inch diameter and a length of about two inches. Selection of the appropriate diameter and length of the trigger post 17 are within the contemplation of a person of ordinary skill in the art. Therefore it is understood that other size trigger posts are contemplated herein, and the selection will correspond to the configuration of the firearm being secured to base plate 12.

Upon mounting firearm 19 to the firearm security device 10 the firearm is positioned such that the bore 60 of barrel 21 slides over the barrel safety rod 16. The firearm 19 is then rotated to lay flat relative to base plate 12 and places the trigger guard 20 around the upstanding trigger post 17. The firearm in its flat position is in a stowed state. It is understood that the post 17 goes through trigger guard 20 in front of the trigger. A security locking means shown in the form of a key activated pad lock 22 having a shank **22*a* is inserted through an aperture 18 in the trigger post 17. Other types of security locking devices may also be employed and the specific disclosure of lock 22 is not intended to limit the types of locking means which may be used in furtherance of the present invention. In the preferred embodiment the aperture 18 is 9/32 inch and located towards the top 80 of post 17. Closing the lock 22 securely holds the firearm 19 to the firearm security device 10. The firearm security device allows for the firearm to be stored fully loaded, except for the chamber under the hammer 75. It is contemplated that firearms such as revolvers, pistols and selected arms can be secured with the firearm security device 10** of the present invention.

The unlocking and removal of lock 22 will allow the firearm to rotate on barrel safety rod 16. The weight of the firearm 19 causes the gun to rotate on the barrel safety rod 16 into a ready position. Therefore, the barrel safety rod 16 functions as a gravity activated swivel rod to deploy the firearm for ready use by the attendant and/or owner. The ready position is when the firearm 19 is oriented substantially perpendicular to the shelf 11.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. A firearm security device, comprising:

a base plate;

a first upstanding post attached to said base plate;

a member connected to said first upstanding post, said member receivable within a barrel of the firearm;

a second upstanding post attached to said base plate, said second post positioned so as to be receivable through the trigger guard of the firearm; and locking means connectable with said second upstanding post for securing the firearm to said second post.

2. The firearm security device of claim 1, wherein said member extending into a chamber of the firearm to prevent the firing thereof, and wherein said member being a barrel safety rod formed of brass.

3. The firearm security device of claim 2, wherein said base plate further includes a plurality of apertures therethrough, said plurality of apertures being located under the firearm so as to prevent access thereto, and further includes a plurality of fasteners for connecting said base plate to a shelf.

4. The firearm security device of claim 3, which further includes an anchor plate, said anchor plate being positioned on the opposite side of the shelf from said base plate, said anchor plate being connected to said base plate by said plurality of fasteners.

5. The firearm security device of claim 4, wherein said second upstanding post sized so that the firearm can rotate over said second post, and wherein said locking means defining a key activated pad lock.

6. A firearm security device, comprising:

a plate;

a barrel lock connected to said plate, said barrel lock positioned parallel to said plate and receivable within a barrel of the firearm;

a trigger post connected to said plate, said trigger post being positionable within a trigger guard of the firearm; and a lock engageable with said trigger post for preventing the removal of the firearm from said trigger post.

7. The firearm security device of claim 6, wherein said barrel lock extending into a chamber of the firearm to prevent the discharge of the firearm, and wherein said cylindrical barrel lock being formed of brass, further including an upstanding post connecting between said plate and said barrel lock.

8. The firearm security device of claim 7, wherein said plate further includes a plurality of apertures therethrough, said plurality of apertures being located under the resting position of the stowed firearm so as to prevent access thereto, and further includes a plurality of fasteners for connecting said base plate to a shelf.

9. The firearm security device of claim 8, which further includes an anchor plate, said anchor plate being positioned on the opposite side of the shelf from said plate, said anchor plate being connected to said plate by said plurality of fasteners and said plate and said anchor plate sandwiching the shelf.

10. The firearm security device of claim 9, wherein said plate formed of about eighty gage steel plate and having a length of about 9½ inches and a width of about 5.25 inches at a first end and about 2 inches at a second end.

11. A firearm security device for preventing the theft and firing thereof, comprising:

a base plate positioned adjacent one surface of the shelf;

an anchor plate positioned adjacent another surface of the shelf, said base plate and said anchor plate being securely connected to the shelf;

a member connected to said base plate and positionable within the barrel of said firearm, said member for preventing the discharge of the firearm and allowing the rotation of the firearm thereon between a first position and a second position;

an upstanding post attached to said base plate, said upstanding post being receivable between a trigger and a trigger guard of the firearm upon the rotation of the firearm to said second position; and locking means connectable with said post for preventing the rotation of said firearm.

12. The firearm security device of claim 11, which further includes a member post attached to said base plate and connecting to said member, said member extending into the bore of the firearm and passing into the firearm chamber and foremed of a material softer than the fiream bore.

13. The firearm security device of claim 12, wherein said base plate further includes a plurality of apertures therethrough, and further includes a plurality of fasteners passing through said plurality of apertures for connecting said base plate to a shelf, said plurality of apertures being located so as to be under the firearm when in a stowed position to prevent tampering with said plurality of fasteners disposed within said plurality of apertures.

14. The firearm security device of claim 13, wherein said anchor plate being position on an upper surface of the shelf and said base plate being positioned on the lower surface of the shelf, said anchor plate being connected to said base plate by said plurality of fasteners, each said plurality of fasteners having an enlarged head and an opposite other threaded end, said enlarged head positioned adjacent said base plate.

15. The firearm security device of claim 13, wherein said upstanding post sized so that the firearm can rotate over said post without interfering with the trigger guard, and wherein said locking means defining a key activated pad lock.

16. A firearm securtity device for mounting a firearm to a shelf while making it readily accessible for deployment, comprising:

a first upstanding post adapted to be connected to and extend from a lower surface of a shelf;

a barrel lock substantially rigidly and non-rotatably connected to said first post and positionable within the barrel of a firearm, said barrel lock allowing the rotation of a firearm thereon between a first stowed position adjacent a shelf and a second ready position; and locking means positionable adjacent a trigger of a firearm and upon the release of said locking means a firearm is revolvable on said barrel lock from said stowed position to said ready position.

17. The firearm security device of claim 16, wherein the firearm rotates between a first position and a second position by gravitational forces.

18. The firearm security device of claim 17, which further includes a trigger post connected to the shelf said trigger post extending from the lower surface of the shelf and corresponding to the opening between the fiream trigger guard and trigger, said upstanding trigger post not interfering with the rotation of the firearm from said first position to said second position.

19. The firearm security device of claim 18, which further includes a base plate, said base plate connected to the shelf and said first upstanding post being attached to said base plate, said trigger post being attached to said base plate, said barrel lock extending into the chamber of the firearm to prevent discharge of the firearm and being formed of brass, and further including an anchor plate positioned on the opposite side of the shelf from said base plate, said anchor plate and said base plate being securely connected to one another and the shelf by a plurality of fasteners, each said plurality of fasteners being a bolt.

* * * * *